US011376648B2

(12) United States Patent
Breen et al.

(10) Patent No.: US 11,376,648 B2
(45) Date of Patent: Jul. 5, 2022

(54) COMPACT STOCK GUIDE ASSEMBLY

(71) Applicant: STANDARD LIFTERS, INC., Grand Rapids, MI (US)

(72) Inventors: Scott M. Breen, Ada, MI (US); Joel T. Pyper, Holland, MI (US)

(73) Assignee: STANDARD LIFTERS, INC., Grand Rapids, MI (US)

( * ) Notice: Subject to any disclaimer, the term of this patent is extended or adjusted under 35 U.S.C. 154(b) by 52 days.

(21) Appl. No.: 16/807,665

(22) Filed: Mar. 3, 2020

(65) Prior Publication Data

US 2020/0282444 A1 Sep. 10, 2020

Related U.S. Application Data

(60) Provisional application No. 62/813,848, filed on Mar. 5, 2019.

(51) Int. Cl.

| | |
|---|---|
| ***B21D 37/10*** | (2006.01) |
| ***B21D 43/00*** | (2006.01) |
| ***B21D 43/02*** | (2006.01) |

(52) U.S. Cl.

CPC ..... *B21D 43/006* (2013.01); *B21D 37/10* (2013.01); *B21D 43/023* (2013.01)

(58) Field of Classification Search

CPC ..... B21D 43/023; B21D 43/08; B21D 43/09; B21D 43/006; B21D 37/10; B21D 37/12; B21D 28/14; B21D 28/02; B21D 28/243; B21D 28/32; B21D 37/20; B30B 7/023; B23P 19/04; B23P 19/10; B23P 15/24

See application file for complete search history.

(56) References Cited

U.S. PATENT DOCUMENTS

| | | | | |
|---|---|---|---|---|
| 2,979,004 | A | 4/1961 | Kenville et al. | |
| 3,848,452 | A | 11/1974 | Gargrave | |
| 4,033,168 | A | 7/1977 | Fisk | |
| 4,282,736 | A | 8/1981 | Mashburn | |
| 4,326,402 | A | 4/1982 | Wallis | |
| 4,704,890 | A | 11/1987 | Vrignaud | |
| 5,974,852 | A | 11/1999 | Nieschulz | |
| 6,848,290 | B2 | 2/2005 | Pyper et al. | |
| 9,010,169 | B2 * | 4/2015 | Breen | B21D 43/023 72/428 |
| 9,694,411 | B2 | 7/2017 | Breen et al. | |

FOREIGN PATENT DOCUMENTS

| | | | | |
|---|---|---|---|---|
| DE | 202009003795 U1 * | 6/2009 | | B21D 28/14 |
| FR | 2966370 | 4/2012 | | |
| JP | 07155867 | 6/1995 | | |
| JP | 07155867 A * | 6/1995 | | B21D 43/023 |

OTHER PUBLICATIONS

Standard Lifters, Inc., "Prior Art Stock Guide Methods," publication date approximately Feb. 2, 2012, p. 20.
Standard Lifters, Inc., "Stock Guide Application," publication date approximately Feb. 2, 2012, p. 5.

* cited by examiner

*Primary Examiner* — Shelley M Self
*Assistant Examiner* — Kevin E O'Brien
(74) *Attorney, Agent, or Firm* — Price Heneveld LLP

(57) ABSTRACT

A compact stock guide assembly and method for metal forming dies includes a stock guide that includes a fastener that secures the stock guide to the die through a central aperture in the stock guide. The stock guide has a locating boss that can be received in a pocket in the die that has been bored and tapped to receive the fastener.

20 Claims, 8 Drawing Sheets

COMPACT STOCK GUIDE ASSEMBLY

CROSS REFERENCE TO RELATED APPLICATION

Applicant hereby claims the priority benefits under the provisions of 35 U.S.C. § 119, basing said claim of priority on related U.S. Provisional Application No. 62/813,848 filed Mar. 5, 2019, which is incorporated in its entirety herein by reference.

BACKGROUND OF THE INVENTION

The present invention relates to metal forming dies and the like, and in particular to a compact stock guide assembly and associated method incorporating a unique stock guide assembly.

Metal forming dies, such as stamping dies and the like, are well known in the art. Progressive metal forming dies are unique, very sophisticated mechanisms which have multiple stations or progressions that are aligned longitudinally, and are designed to perform a specified operation at each station in a predetermined sequence to create a finished metal part. Progressive stamping dies are capable of forming complex metal parts at very high speeds, so as to minimize manufacturing costs.

Heretofore, the dies used in metal forming presses have typically been individually designed, one-of-a-kind assemblies for a particular part, with each of the various components being handcrafted and custom mounted or fitted in an associated die set, which is in turn positioned in a stamping press. Not only are the punches and the other forming tools in the die set individually designed and constructed, but the other parts of the die set, such as stock lifters, guides, end caps, keepers, cam returns, etc., are also custom designed, and installed in the die set. Current die making processes require carefully machined, precision holes and recesses in the die set for mounting the individual components, such that the same are quite labor intensive, and require substantial lead time to make, test, and set up in a stamping press. Consequently, such metal forming dies are very expensive to design, manufacture, and repair or modify.

In metal forming machines, a die is typically mounted in a stamping press, and the material to be stamped (typically an elongated strip of metal) is fed into the die. The material can be fed by automated feed equipment meant to keep the material flowing straight through the die. Stock guides can guide the material (typically along the longitudinal axis of the material) to keep the material moving in a straight line through the die.

While such prior stock guides and methods have been proven to be generally successful, further improvements and enhancements to the same, as well as metal forming dies generally, would be advantageous and are described herein.

SUMMARY OF THE INVENTION

One aspect of the present invention is a stock guide assembly for a metal forming die in which stock is formed into at least one part. The stock guide assembly includes a stock guide body with an outer end portion, an inner end portion, and a medial portion. The stock guide body has a centrally located aperture extending through the stock guide body. The outer end portion of the stock guide body has a width that is greater than the width of the medial portion of the stock guide body forming a first shoulder therebetween. The width of the inner end portion is less than the width of the medial portion forming a second shoulder therebetween. The die member has an aperture with at least a first portion and a second portion. A fastener is received through the centrally located aperture and the stock guide body and is coupled to the second portion of the aperture in the die member to couple the stock guide body to the die member. When the stock guide body is coupled to the die member, the inner end portion of the stock guide body is at least partially received in the first portion of the aperture in the die member.

Another aspect of the present invention is a metal forming die member with a stock guide assembly for guiding a stock piece. The stock guide assembly includes a generally cylindrical stock guide body with an outer end portion, an inner end portion, and a medial portion. The stock guide body has a centrally located aperture extending through the stock guide body. The outer end of the stock guide body has a width that is greater than the width of the medial portion, forming a first shoulder therebetween. The inner end portion of the stock guide body has a width which is less than the width of the medial portion forming a second shoulder therebetween. The die member has an aperture with a first portion sized to receive at least a part of the inner end portion of the stock guide body and a second portion. The stock guide assembly also includes a fastener that is received through the centrally located aperture in the stock guide body. The fastener is coupled to the second portion of the aperture in the die member.

In yet another aspect of the present invention is a method of advancing stock strip through a metal forming die. The method includes forming a stock guide body with an outer end portion, an inner end portion, a medial portion, and a centrally located aperture extending through the stock guide body. The outer end portion has a width that is greater than the width of the medial portion, thereby forming a first shoulder therebetween. The inner end portion has a width that is less than the width of the medial portion thereby forming a second shoulder therebetween. The method includes forming an aperture in the die member with a first portion sized to receive the inner end portion of the stock guide body and a lower, more narrow threaded portion. The method includes placing the stock guide body over the aperture in the die member such that at least a portion of the inner end portion of the stock guide body is received in the first portion of the aperture in the die member. The method includes inserting a fastener through the centrally located aperture in the stock guide body and then coupling a threaded portion of the fastener to the more narrow threaded portion of the aperture in the die member. The method includes advancing a piece of stock strip by contacting the stock strip against the medial portion of the stock guide body.

These and other advantages of the invention will be further understood and appreciated by those skilled in the art by reference to the following written specification, claims, and appended drawings.

BRIEF DESCRIPTION OF THE DRAWINGS

FIG. 12 is a side perspective view of two different sizes of the stock guide shown in

FIG. 2;

DETAILED DESCRIPTION OF THE PREFERRED EMBODIMENTS

Figure 1:
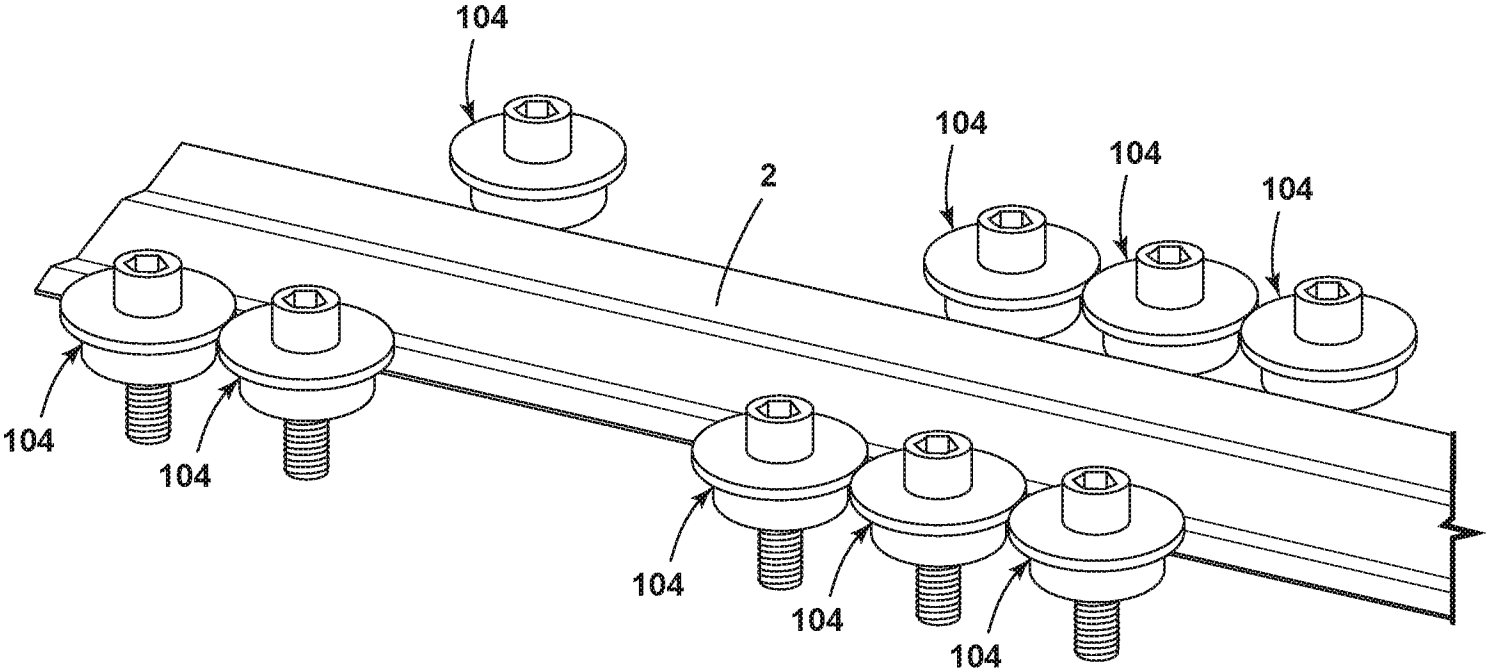
FIG. 1 is perspective view of a number of stock guide assemblies with a piece of stock strip position therebetween.
Figure 3:
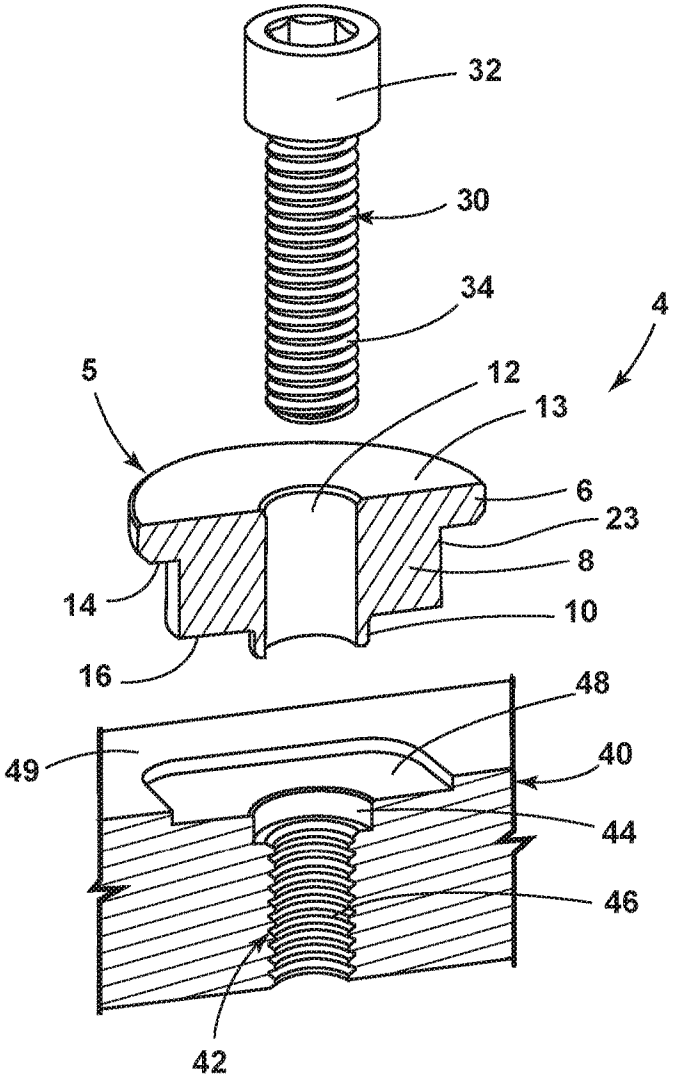
FIG. 3 is an exploded cross-sectional perspective view of another embodiment of the stock guide.
Figure 2:
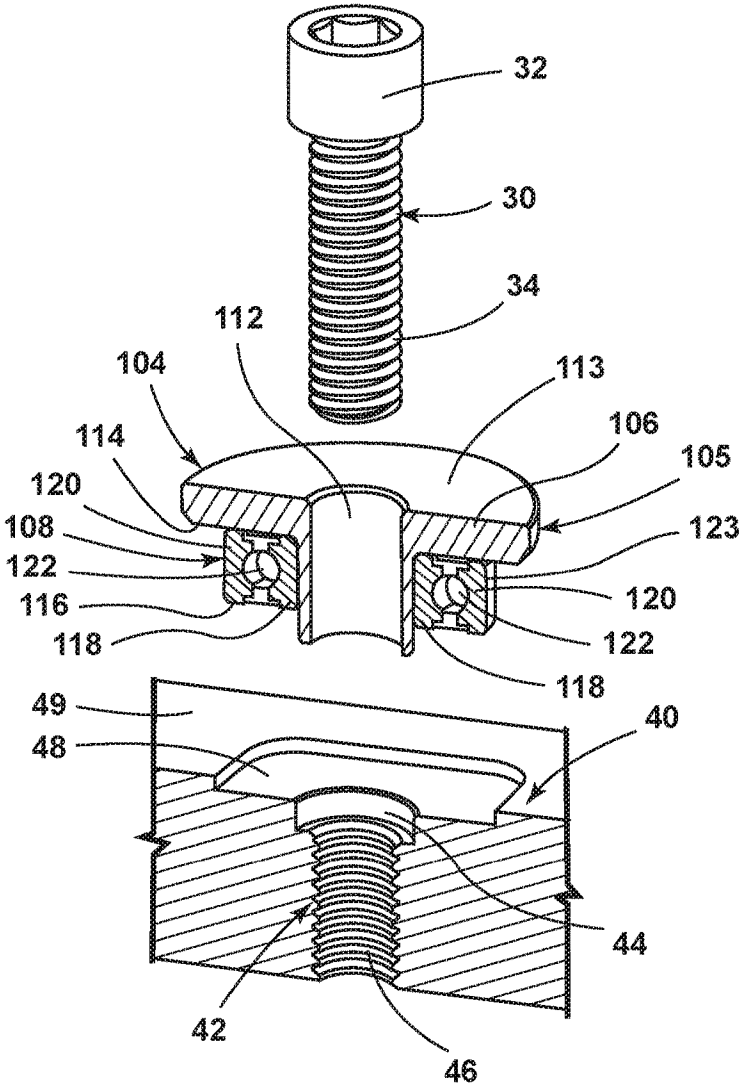
FIG. 2 is an exploded cross-sectional perspective view of an embodiment of the stock guide utilizing bearings.
Figure 5:
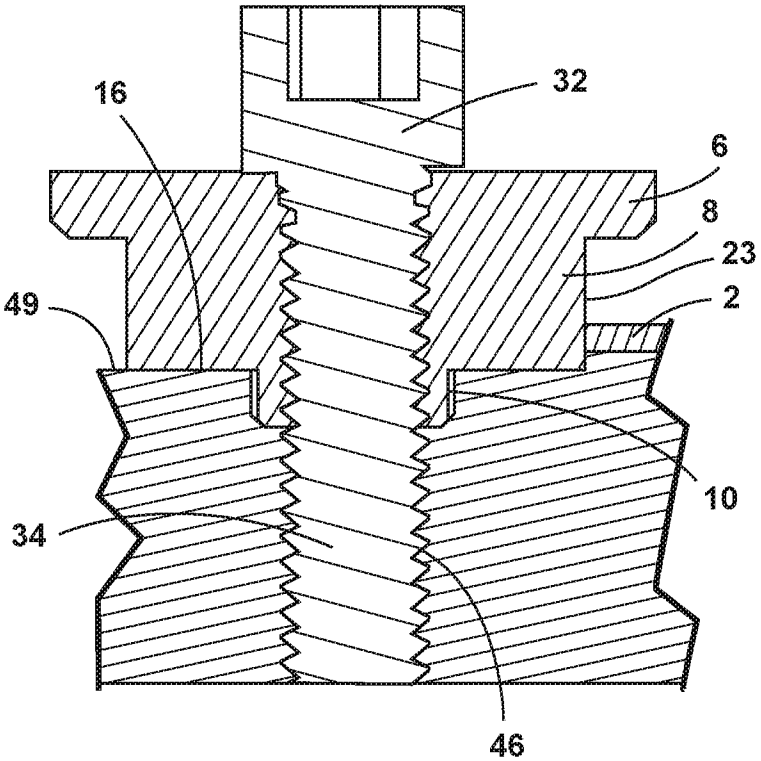
FIG. 5 is a cross-sectional view of the stock guide shown in FIG. 3 coupled to a die member.

For purposes of description herein, the terms "upper," "lower," "right," "left," "rear," "front," "vertical," "horizontal," and derivatives thereof shall relate to the invention as oriented in the attached drawings. The "width" of generally cylindrical components is referred to as "width" or "diameter." Similarly, the "width" of components that are a multi-faceted cylindrical shape is referred to as "width" or "diameter." However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring initially to FIGS. 1, 2, 4, 6, 8, 11, and 12, there is shown a stock guide assembly 104 for guiding a stock piece 2 in a metal forming die. The stock guide assembly 104 includes a stock guide body 105. Stock guide body 105 has an outer end portion 106, a medial portion 108, and an inner end portion 110. The width or diameter of the outer end portion 106 is greater than the width or diameter of the medial portion 108, thereby forming a first shoulder 114 therebetween. The width or diameter of the inner end portion 110 is less than the width or diameter of the medial portion 108, thereby forming a second shoulder 116. A centrally located aperture 112 extends from the top surface 113 of the stock guide body 105 all the way through the stock guide body 105.

The medial portion 108 consists of an inner race 118 and an outer race 120 between which bearings 122 are positioned. This permits the outer race 120 to rotate with respect to the inner race 118. The inner race 118 is fixed with respect to the remainder of the stock guide body 105 thereby permitting the outer surface 123 of outer race 120 to rotate with respect to the remainder of the stock guide body 105.

Stock guide assembly 104 also includes a fastener 30. The fastener 30 has a head 32 and a threaded shaft 34. The head 32 of fastener 30 can be actuated by drill, driver, or other mechanism. In the illustrated embodiment, the head 32 has a hexagonal shape for connecting to a similar-shaped driving mechanism.

A die member 40 includes an aperture 42. The aperture 42 includes a first portion 44 that is sized to receive at least a part of the inner end portion 110 of the stock guide body 105. The aperture 42 includes a lower, more-narrow threaded portion 46. A pocket 48 can be formed in the die member 40 around the aperture 42. The pocket 48 can be shaped to place a part of the medial portion 108 of the stock guide body 105 below the upper surface 49 of the die member 40. In addition, the pocket 48 can be shaped to prevent or permit the rotation of the medial portion 108 of the stock guide body 105 when the stock guide body 105 is installed on the die member 40.

In order to install the stock guide body 105 on the die member 40, the fastener 30 is inserted through the centrally located aperture 112 in the stock guide body 105. At least a portion of the inner end portion 110 of the stock guide body 105 is received within the first portion 44 of the aperture 42 in die member 40. When the fastener 30 is advanced, the threaded shank portion 34 of the fastener 30 will couple with the second portion 46 of the aperture 42.

Figure 4:
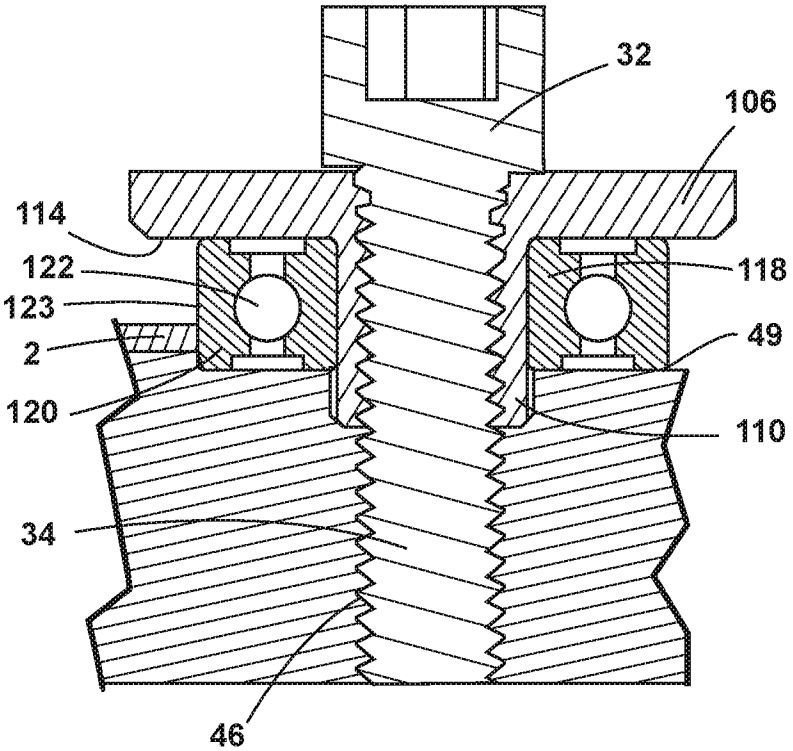
FIG. 4 is a cross-sectional view of the stock guide shown in FIG. 2 coupled to a die member.

As illustrated in FIG. 1, the stock piece 2 can be moved along the die member 40 by being guided by stock guide assemblies 104 that are located and spaced apart on opposite sides of the stock piece 2. The stock piece 2 will contact the outer surface 123 of the outer race 120, as illustrated in FIG. 4. This permits the stock guide assemblies 104 to direct the stock piece 2 in the desired manner.

Figure 6:
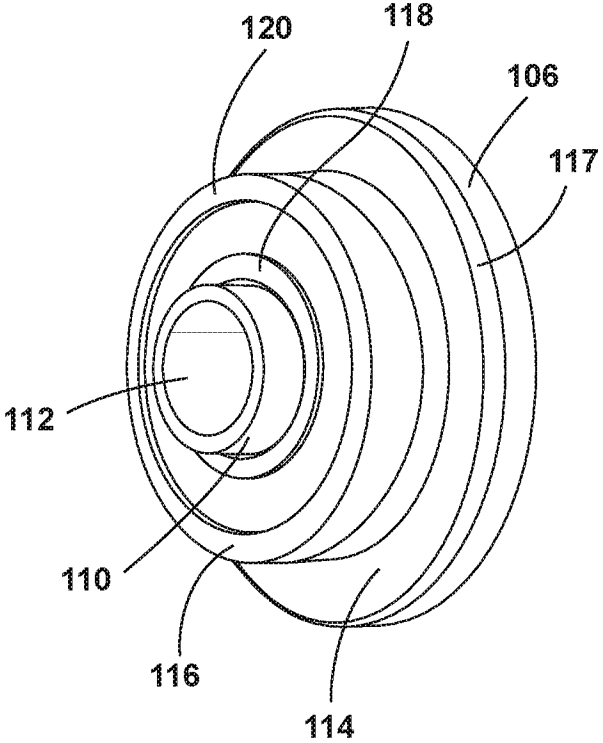
FIG. 6 is a bottom perspective view of the stock guide shown in FIG. 2.
Figure 9:
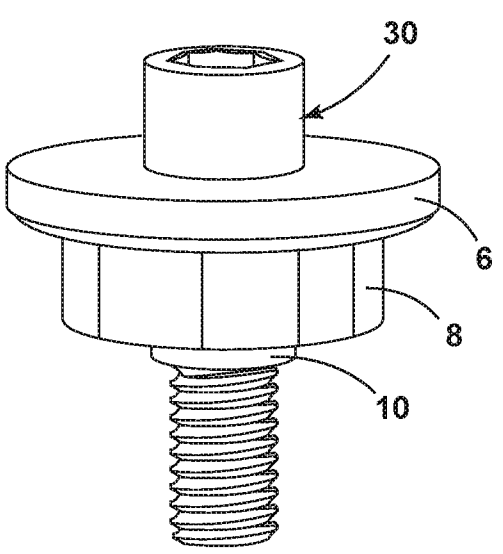
FIG. 9 is a side perspective vie of the stock guide shown in FIG. 3.
Figure 8:
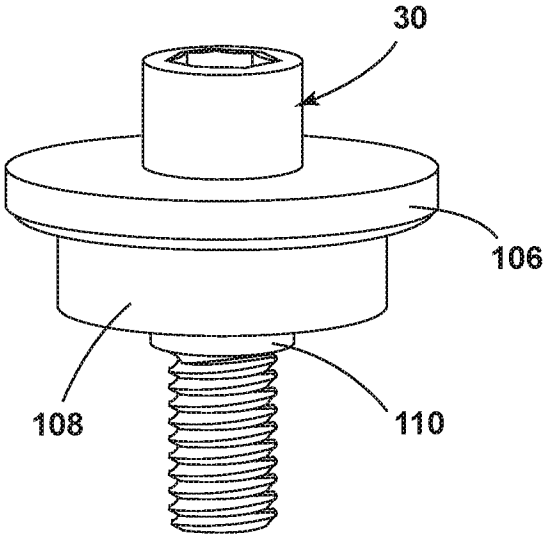
FIG. 8 is a side perspective view of the stock guide shown in FIG. 2.
Figure 10:
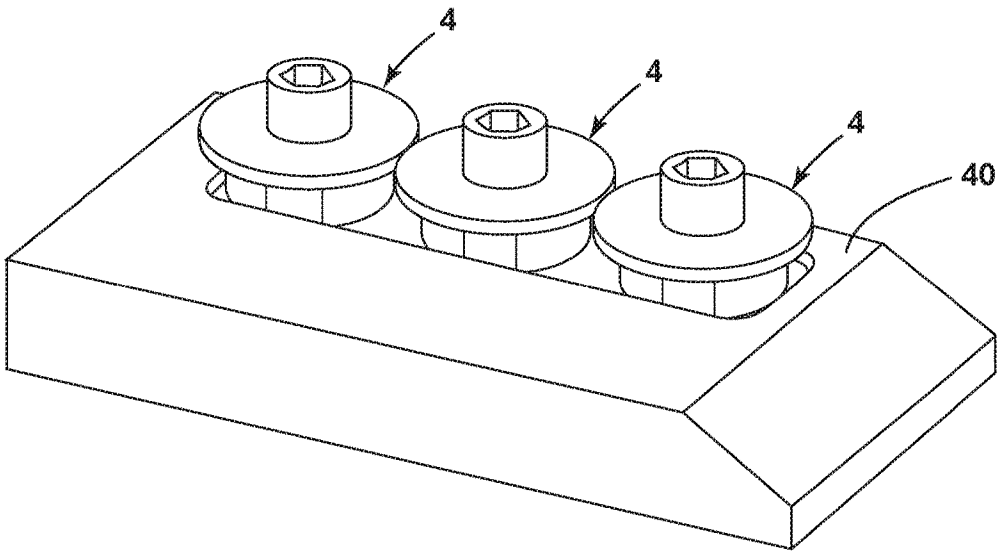
FIG. 10 is a view of three stock guides as shown in FIG. 3, installed in a die member in sequence.
Figure 11:
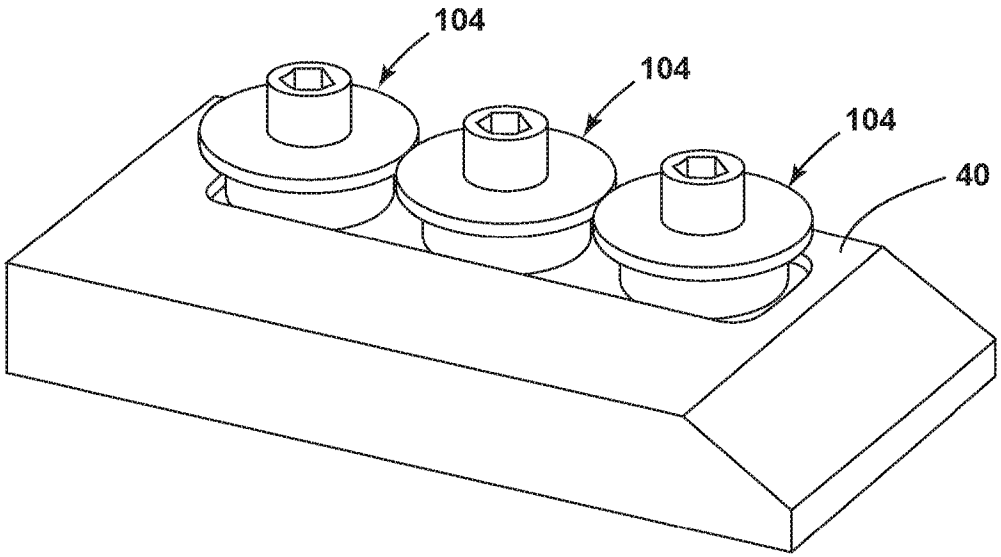
FIG. 11 is a side perspective view of three stock guides, as shown in FIG. 2, installed in a die member in sequence.
Figure 13:
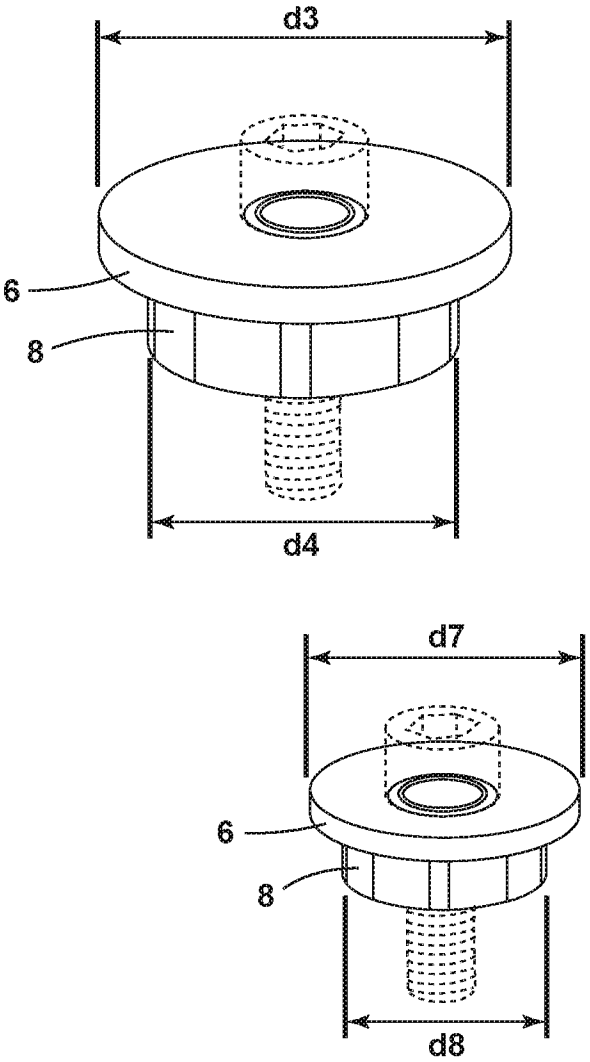
FIG. 13 is a side-perspective view of two different sizes of the stock guide shown in FIG. 3.

As illustrated in FIG. 6, the outer end portion 106 of the stock guide body 105 can have a tapered or chamfered surface 117. In the illustrated embodiments, the outer surface 123 of the outer race 120 is generally cylindrical, however, an outer race 120 with a multi-faceted exterior surface can be used.

FIGS. 3, 5, 7, 9, 10, and 13 illustrate another embodiment of the stock guide assembly 4. In this embodiment, the stock guide body 5 consists of a unitary piece. The stock guide 5 has an outer end 6, a medial portion 8, and an inner end portion 10. The stock guide body 5 includes a centrally located aperture 12.

Figure 7:
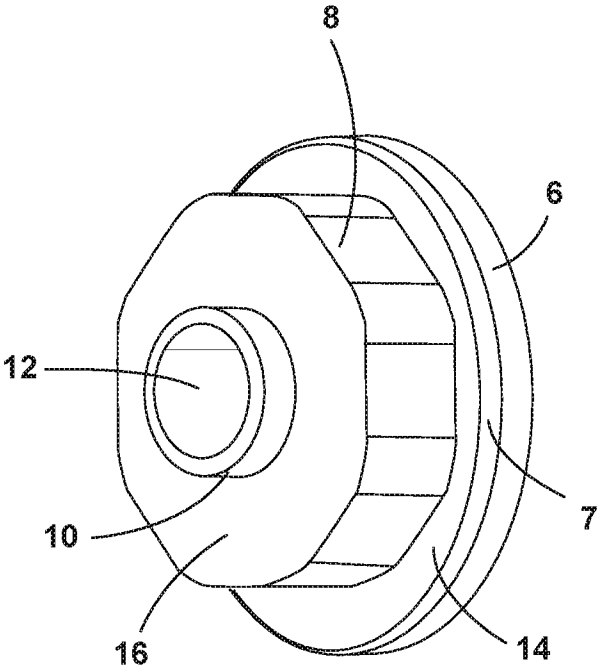
FIG. 7 is a bottom perspective view of the stock guide shown in FIG. 3.

The stock guide body 5 is coupled to the die member 40 by the insertion of at least a portion of the inner end portion 10 into the first portion 44 of the aperture 42 in die member 40. A fastener 30 is inserted through the centrally located aperture 12 to engage the threaded second portion 46 of aperture 42 in die member 40 to couple the stock guide body 5 to the die member 40. In the illustrated embodiments, the medial portion 8 includes a multi-faceted surface, as illustrated in FIG. 7. The medial portion 8 has a width that is less than the diameter of the outer end portion 6 thereby forming first shoulder 14 therebetween. The diameter of the inner end portion 10 is less than the width of the medial portion 8 thereby forming the second shoulder 16.

As illustrated in FIGS. 7, 9, 10, and 13, the medial portion 8 has multiple facets which results in a generally cylindrical shape with multiple facets. Given that the stock guide body 5 is a unitary piece, the medial portion 8 will not rotate with respect to the remainder of the stock guide body 5. Thus, when the stock guide body 5 is fully installed into die member 40, the outer surface 23 of the medial portion 8 that contacts the stock piece 2 is stationary with respect to the die member 40.

The pocket 48 formed on die member 40 can be shaped to prevent the rotation of the stock guide body 5 by having one or more wall(s) that engage one or more of the facets on the outer surface 23 of the medial portion 8 of the stock guide body 5.

Figure 14:
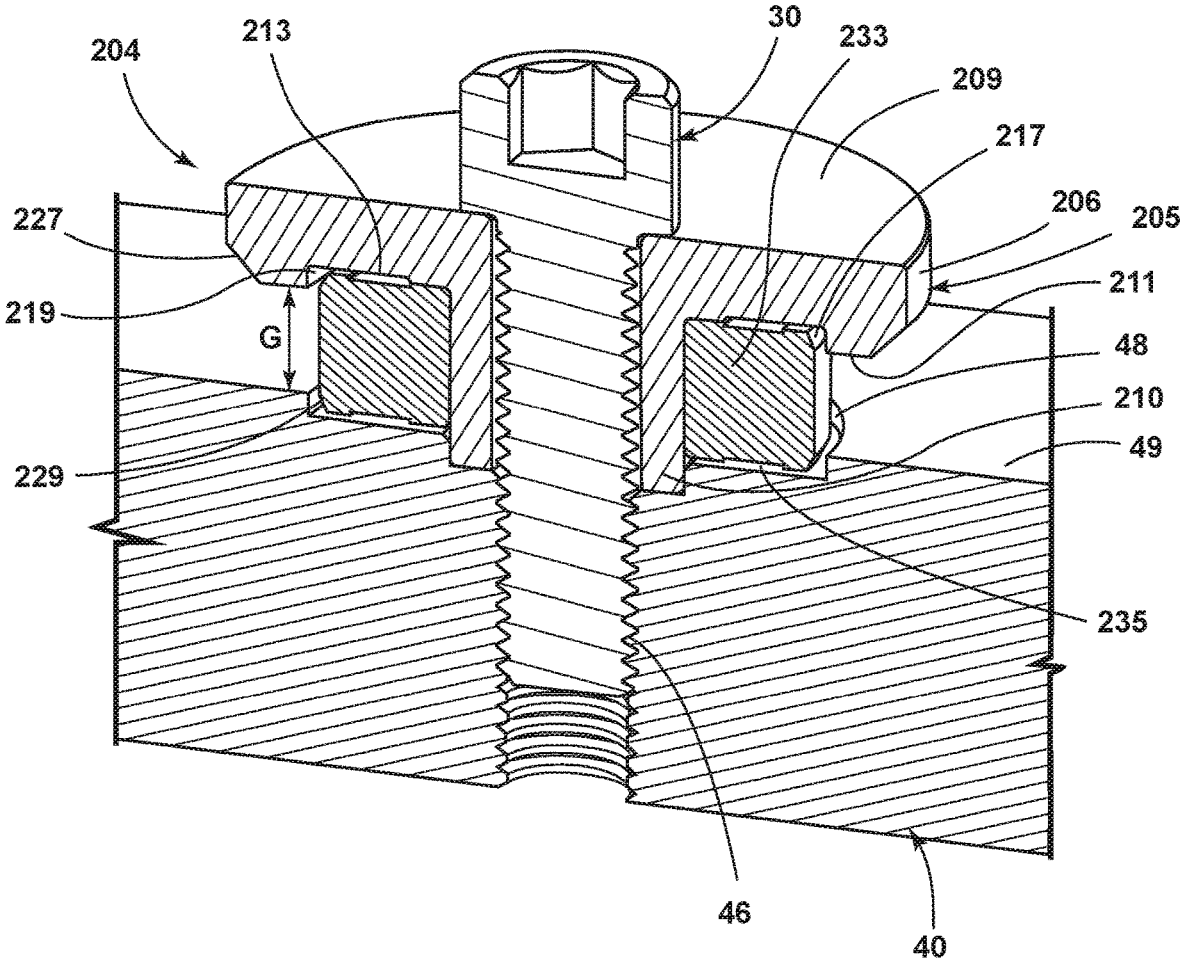
FIG. 14 is a front perspective, cross-sectional view of another embodiment of a stock guide installed on a die member.

Another embodiment of the stock guide assembly 204 is shown in FIG. 14. In that embodiment, the stock guide body 205 has an outer end portion 206 and an inner end portion 210. The inner end portion 210 is received within the aperture 42 in die member 40. The threaded shank portion of fastener 40 couples with the second portion 46 of the aperture 42. The outer end portion 206 includes a chamfered portion 227 and a lip 219, which goes over the upper chamfered portion 217 of the bearing assembly 233. The lower chamfered portion 229 of the bearing assembly is located below the upper surface 49 of the die member 40 based upon the depth of the pocket 48 in die member 40. This allows the gap G between the top surface 49 of the die member 40 and surface 211 of the outer end portion 206 of the stock guide body 205 to be reduced. In this arrangement, the stock piece 2 will not contact a chamfered surface (217, 229) of the bearing assembly 233. In addition, once the fastener 30 is secured to the top surface 209 of the stock guide body 205, there will be a clearance 213 above the bearing assembly 233 and a clearance 235 below the bearing assembly 233.

Figure 12:
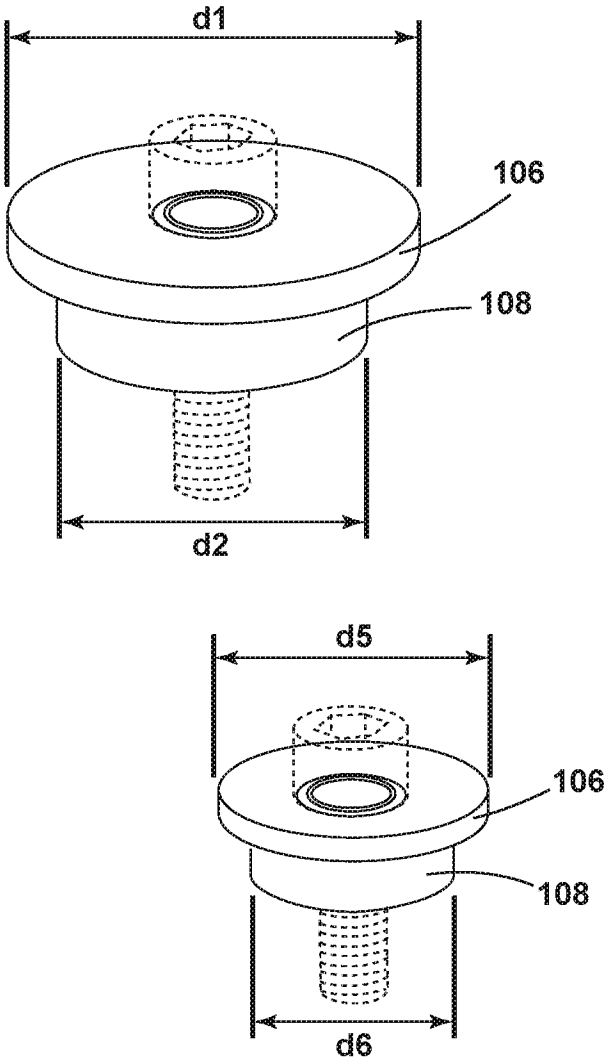

The stock guide assemblies (4, 104, 204) can be sized to accommodate different sized stock pieces 2 and different sized die members 4. In the illustrated examples, the sizes are approximately 38 mm and 58 mm. Thus, diameter d1 of the larger assembly in FIG. 12 is approximately 58 mm, while d2 is approximately 42 mm. The diameter d5 of the smaller assembly in FIG. 12 is approximately 38 mm and the diameter d6 is approximately 28 mm. Similarly, the larger assembly in FIG. 13 has a diameter d3 of approximately 58 mm and a diameter d4 of approximately 42 mm. The smaller assembly in FIG. 13 has a diameter d7 of approximately 38 mm and a diameter d8 of approximately 28 mm. The exterior surface of the medial portion 8 in the larger assembly of FIG. 13 has forty-two flats or facets. The exterior surface of the medial portion 8 in the smaller assembly of FIG. 13 has twenty-eight flats or facets.

In the foregoing description, it will be readily appreciated by those skilled in the art that modifications may be made to the invention without departing from the concepts disclosed herein. Such modifications are to be considered as included in the following claims, unless these claims by their language expressly state otherwise.

It will be understood by one having ordinary skill in the art that construction of the present disclosure and other components is not limited to any specific material. Other exemplary embodiments of the disclosure disclosed herein may be formed from a wide variety of materials, unless described otherwise herein.

For purposes of this disclosure, the term "coupled" or "operably coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

For purposes of this disclosure, the term "connected" or "operably connected" (in all of its forms, connect, connecting, connected, etc.) generally means that one component functions with respect to another component, even if there are other components located between the first and second component, and the term "operable" defines a functional relationship between components.

It is also important to note that the construction and arrangement of the elements of the present disclosure as shown in the exemplary embodiments is illustrative only. Although only a few embodiments of the present innovations have been described in detail in this disclosure, those skilled in the art who review this disclosure will readily appreciate that, unless otherwise described, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating positions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

The invention is claimed as follows:

1. A stock guide assembly for a metal forming die in which stock is formed into at least one part, comprising:

a generally cylindrical stock guide body with an outer end portion, an inner end portion, a medial portion, and a centrally located aperture, having a single uniform diameter, extending through said stock guide body, wherein:

said outer end portion has a first width;

said medial portion having an outer surface with a second width which is less than said first width of said outer end portion forming a first external shoulder around the entire periphery of said stock guide body;

said inner end portion has a third width which is less than said second width of said medial portion, forming a second shoulder therebetween;

a die member having an aperture comprising a first portion with a first aperture width and a second portion with a second aperture width which is less than said first width to form an aperture shoulder therebetween;

a fastener that is received through said centrally located aperture in said stock guide body and coupled to said second portion of said aperture in said die member to couple said stock guide to said die member; and wherein said inner end portion of said stock guide body is at least partially received in said first portion of said aperture in said die member with said second shoulder of said stock guide body directly contacting said aperture shoulder.

2. The stock guide assembly of claim 1, wherein said stock guide body is a unitary piece.

3. The stock guide assembly of claim 1, wherein said stock guide body comprises a first piece of material that forms the inner end portion and the outer end portion of the stock guide body and a second piece of material that forms the medial portion of the stock guide body.

4. The stock guide assembly of claim 3, wherein said outer surface of said medial portion of the stock guide body rotates with respect to the remainder of the stock guide body.

5. The stock guide assembly of claim 4, wherein said medial portion includes internal bearings.

6. The stock guide assembly of claim 1, wherein said stock guide body is formed from hardened steel.

7. The stock guide assembly of claim 1, wherein a portion of said fastener and a portion of said second portion of said aperture in said die member are threaded.

8. The stock guide assembly of claim 1, wherein said outer surface of said medial portion of said stock guide body is cylindrical.

9. The stock guide assembly of claim 1, wherein said outer surface of said medial portion of said stock guide body has multiple facets.

10. A metal forming die member with a stock guide assembly for guiding a stock piece, comprising:

a generally cylindrical stock guide body with an outer end portion, an inner end portion, a medial portion, and a centrally located single uniform diameter aperture extending through said stock guide body, wherein:

said outer end portion has a first width;

said medial portion has a second width which is uniformly less than said first width of said outer end portion, forming a first external shoulder around the entire periphery of said stock guide body;

said inner end portion has a third width which is less than said second width of said medial portion, forming a second shoulder therebetween;

a die member with an aperture having a first portion with a first aperture width, sized to receive at least a part of said inner end portion of said stock guide body, and a second portion with a second aperture width that is smaller than said first width forming an aperture shoulder therebetween; and a fastener that is received through said centrally located aperture in said stock guide body and coupled to said second portion of said die member, such that said second shoulder of said stock guide body directly contacts said aperture shoulder.

11. The metal forming die member of claim 10, wherein said die member has a pocket which surrounds a portion of said medial portion of said stock guide body.

12. The metal forming die member of claim 10, wherein said stock guide body is formed from a single piece of material.

13. The metal forming die member of claim 10, wherein said medial portion of said stock guide body is a bearing assembly.

14. The metal forming die member of claim 13, wherein said medial portion of said stock guide body rotates with respect to said die member.

15. The metal forming die member of claim 10, wherein said fastener includes a threaded shank portion that is coupled to a threaded portion of said second aperture in said die member.

16. The metal forming die member of claim 10, wherein said medial portion of said stock guide body has a multi-faceted exterior surface.

17. The metal forming die member of claim 16, wherein the multi-faceted exterior surface includes a plurality of flat sections.

18. A method of advancing a stock strip, comprising:

forming a stock guide body with an outer end portion, an inner end portion, a medial portion, and a centrally located single uniform diameter aperture extending through said stock guide body, wherein:

said outer end portion has a first width;

said medial portion has a second width which is less than said first width of said outer end portion forming an external first shoulder around the entire periphery of said stock guide body;

said inner end portion has a third width which is less than said second width of said medial portion, forming a second shoulder therebetween;

forming an aperture in a die member with a first portion sized to receive said inner end portion of said stock guide body and a lower, narrower threaded portion forming an aperture shoulder therebetween;

placing said stock guide body over said aperture in said die member such that at least a portion of said inner end portion of said stock guide body is received in the first portion of said aperture in said die member with the second shoulder of the stock guide body contacting said aperture shoulder;

inserting a fastener through said centrally located aperture in said stock guide body;

coupling a threaded portion of said fastener to said more narrow threaded portion of said aperture in said die member; and advancing a piece of stock strip by directly contacting said stock strip against said medial portion of said stock guide body.

19. The method of advancing the stock strip of claim 18, wherein said aperture forming step includes forming a pocket that contacts said second shoulder of said stock guide body.

20. The method of advancing the stock strip of claim 18, further including:

coupling multiple stock guide assemblies to said die member to create a pathway for advancing said stock strip.

* * * * *